US009252524B2

(12) United States Patent
Kobayashi

(10) Patent No.: US 9,252,524 B2
(45) Date of Patent: Feb. 2, 2016

(54) TERMINAL HAVING A PAIR OF ELASTIC CONTACT PIECES WITH INWARDLY AND OUTWARDLY BENT PORTIONS

(75) Inventor: Masaki Kobayashi, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 5 days.

(21) Appl. No.: 13/978,803

(22) PCT Filed: Feb. 3, 2012

(86) PCT No.: PCT/JP2012/052471

§ 371 (c)(1),
(2), (4) Date: Jul. 9, 2013

(87) PCT Pub. No.: WO2012/105679

PCT Pub. Date: Aug. 9, 2012

(65) Prior Publication Data

US 2013/0288519 A1 Oct. 31, 2013

(30) Foreign Application Priority Data

Feb. 4, 2011 (JP) ..... 2011-023278

(51) Int. Cl.
*H01R 13/52* (2006.01)
*H01R 13/11* (2006.01)

(52) U.S. Cl.
CPC ..... *H01R 13/52* (2013.01); *H01R 13/113* (2013.01); *H01R 13/521* (2013.01)

(58) Field of Classification Search
CPC .... H01R 13/11; H01R 13/111; H01R 13/113; H01R 13/18; H01R 13/52
USPC ..... 439/487, 843, 852
See application file for complete search history.

(56) References Cited

U.S. PATENT DOCUMENTS

| | | | | |
|---|---|---|---|---|
| 3,711,819 | A | 1/1973 | Matthews | |
| 4,950,183 | A * | 8/1990 | Watanabe et al. | 439/843 |
| 5,775,962 | A * | 7/1998 | Kakuta et al. | 439/852 |
| 6,095,874 | A * | 8/2000 | Quaranta | 439/852 |

(Continued)

FOREIGN PATENT DOCUMENTS

| | | | |
|---|---|---|---|
| CN | 101409398 | A | 4/2009 |
| CN | 101872914 | A | 10/2010 |

(Continued)

OTHER PUBLICATIONS

International Search Report dated Mar. 27, 2012 issued in International Application No. PCT/JP2012/052471 (PCT/ISA/210).

(Continued)

*Primary Examiner* — Chandrika Prasad
(74) *Attorney, Agent, or Firm* — Sughrue Mion, PLLC

(57) ABSTRACT

A terminal includes an elastic contact piece. The elastic contact piece comes into elastic contact with a counterpart terminal in a terminal container. The elastic contact piece includes a bent portion bent and extending from a portion of a side wall of the terminal container in the terminal container, and a clamping portion extending from a front end of the bent portion in the terminal container along an extending direction of the side wall. A dimension of the clamping portion is longer than a dimension of the bent portion in the extending direction, so as to prevent a foreign substance from entering between an inner wall of the terminal container and the clamping portion.

5 Claims, 4 Drawing Sheets

(56) References Cited

U.S. PATENT DOCUMENTS

| | | | | |
|---|---|---|---|---|
| 6,283,803 | B1 | 9/2001 | Sato et al. | |
| 6,341,984 | B1 * | 1/2002 | Murakami et al. | 439/587 |
| 6,565,396 | B2 * | 5/2003 | Saka et al. | 439/843 |
| 6,755,697 | B2 * | 6/2004 | Kojima et al. | 439/852 |
| 6,758,701 | B2 * | 7/2004 | Kato | 439/852 |
| 6,790,101 | B1 * | 9/2004 | Data et al. | 439/851 |
| 8,668,532 | B2 * | 3/2014 | Lee et al. | 439/851 |
| 2001/0051471 | A1 * | 12/2001 | Saka et al. | 439/843 |
| 2010/0173539 | A1 | 7/2010 | Furutani et al. | |
| 2010/0197178 | A1 | 8/2010 | Hotea et al. | |
| 2010/0273366 | A1 | 10/2010 | Okano | |

FOREIGN PATENT DOCUMENTS

| | | | |
|---|---|---|---|
| CN | 101933196 | A | 12/2010 |
| JP | 48-092894 | S | 2/1973 |
| JP | 1-103178 | U | 7/1989 |
| JP | 3-62466 | U | 6/1991 |
| JP | 2000-311740 | A | 11/2000 |
| JP | 2001-351739 | A | 12/2001 |
| JP | 2003-123887 | A | 4/2003 |
| WO | 2010/134712 | A2 | 11/2010 |

OTHER PUBLICATIONS

Communication from the European Patent Office issued Feb. 19, 2015 in a counterpart European Application No. 12741851.5.

Communication from the State Intellectual Property Office of P.R. China dated Feb. 3, 2015 in a counterpart application No. 201280007398.0.

Office Action dated Sep. 30, 2014 issued by the Japanese Patent Office in counterpart Japanese Patent Application No. 2011-023278.

Communication dated Sep. 25, 2015 issued by The State Intellectual Property Office of The People's Republic of China in counterpart Chinese Application No. 201280007398.0.

* cited by examiner

TERMINAL HAVING A PAIR OF ELASTIC CONTACT PIECES WITH INWARDLY AND OUTWARDLY BENT PORTIONS

TECHNICAL FIELD

The present invention is related to a terminal capable of coming an elastic contact piece into elastic contact with a counterpart terminal in a terminal container.

BACKGROUND ART

As disclosed in PTLs 1 and 2, there is a terminal capable of coming an elastic contact piece into elastic contact with a counterpart terminal which is inserted into a terminal container, thereby clamping the counterpart terminal in the terminal container. The elastic contact piece disclosed in PTL 1 is formed in a flat shape, except for a front end which is brought into contact with the counterpart terminal. The elastic contact piece is disposed in the terminal container to be overlapped with a side wall of the terminal container. In PTL 2, a portion of the side wall of the terminal container is gently inclined in the terminal container to form an elastic contact piece.

CITATION LIST

Patent Literature

[PTL 1] JP-A-2000-311740
[PTL 2] JP-A-2001-351739

SUMMARY OF INVENTION

Technical Problem

In the terminals of the related art, as foreign substances are sandwiched between the elastic contact piece and a terminal cavity of a connector housing or the side wall of the terminal container, a repulsion force of the elastic contact piece which comes into elastic contact with the counterpart terminal is increased, so that insertion/extraction force of the counterpart terminal to the terminal container may be increased.

The present invention has been made in view of the above-described problem, and an object of the present invention is to provide a terminal in which an elastic contact piece can be bent without being affected by foreign substances entered in a terminal container or a terminal cavity.

Solution to Problem

The above object of the present invention can be achieved by the following configuration.

(1) A terminal including an elastic contact piece configured to come into elastic contact with a counterpart terminal in a terminal container, wherein the elastic contact piece is bent in a direction of elastic contact with the counterpart terminal, and then extends in a direction of insertion/extraction of the counterpart terminal to the terminal container.

(2) A terminal including an elastic contact piece configured to come into elastic contact with a counterpart terminal in a terminal container, wherein the elastic contact piece includes a bent portion bent and extending from a portion of a side wall of the terminal container in the terminal container, and a clamping portion extending from a front end of the bent portion in the terminal container along an extending direction of the side wall.

(3) The terminal according to the configuration of the above (1) or (2), wherein a pair of contact portions provided on the opposite side walls of the terminal container clamp the counterpart terminal in the terminal container.

According to the terminal including the configuration of the above (1) to (3), gaps greater than bending ranges of the elastic contact pieces are formed between inner walls of a terminal cavity and the elastic contact pieces, and thus the elastic contact pieces can be bent without being affected by a foreign substance entered between the inner walls of the terminal cavity and the elastic contact pieces.

DESCRIPTION OF EMBODIMENTS

Embodiments of the present invention will now be described with reference to the accompanying drawings.

Each direction of upward and downward (arrow U and arrow D), front and back (arrow F and arrow B), and left and right (arrow L and arrow R) used in the explanation below is indicated in each drawing used in the explanation. These upward and downward, front and back, and left and right are referred for the explanation, and, of course, may be different from actual arrangement.

Figure 1B:
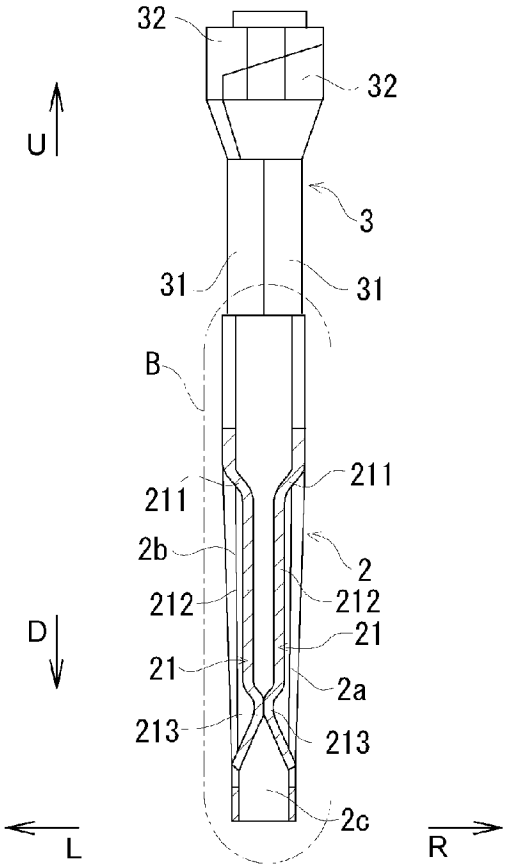
FIG. 1B is a cross-sectional view when seen from a direction of the arrow A-A in FIG. 1A.
Figure 1A:
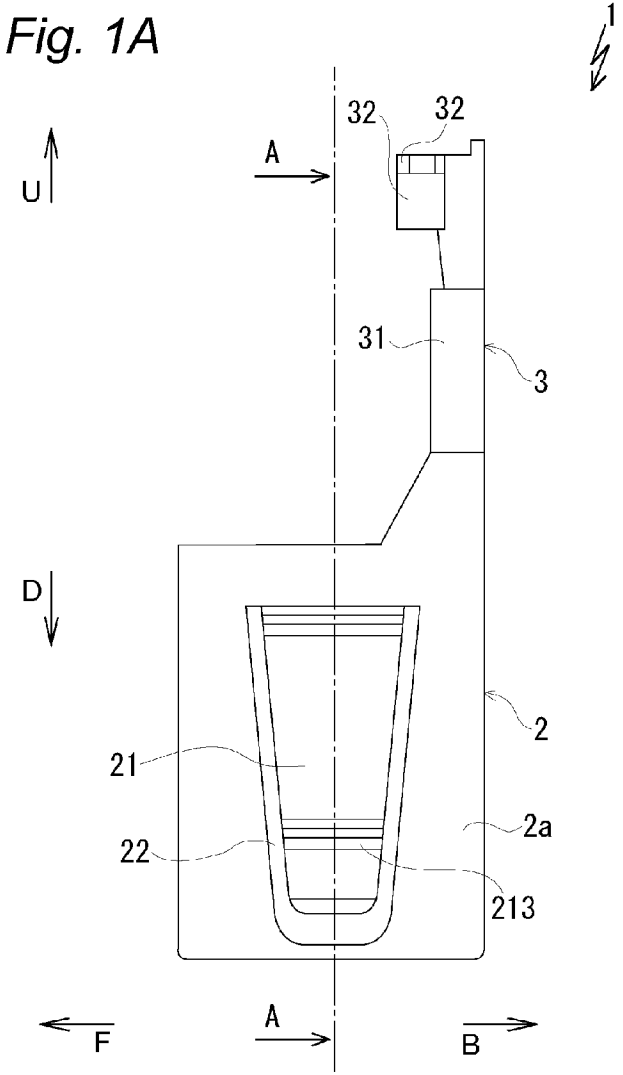
FIG. 1A is a right side view illustrating a terminal according to one embodiment of the present invention.

A terminal illustrated in FIGS. 1A and 1B includes a terminal container 2 for receiving a counterpart terminal (not illustrated) therein, and an electric wire connection 3 which is connected to an electric wire (not illustrated). The electric wire connection 3 has a metal core crimping portion 31 for crimping a metal core of the electric wire, and a sheath crimping portion 32 for crimping an insulated coating layer of the electric wire.

The terminal container 2 has a right lateral plate (side wall) 2*a*, a left lateral plate (side wall) 2*b*, and a rear plate 2*c*, in which edge portions of the lateral plates are connected to a rear plate 2*c*. The terminal container 2 has a U-shaped cross-sectional shape, and is extended in an upward and downward direction in the drawing. The right lateral plate 2*a* and the left lateral plate 2*b* have elastic contact pieces 21 at opposite positions. The elastic contact piece 21 has a tongue piece formed by providing a U-shaped slit 22 on the left and right lateral plates 2*a* and 2*b*.

Figure 2:
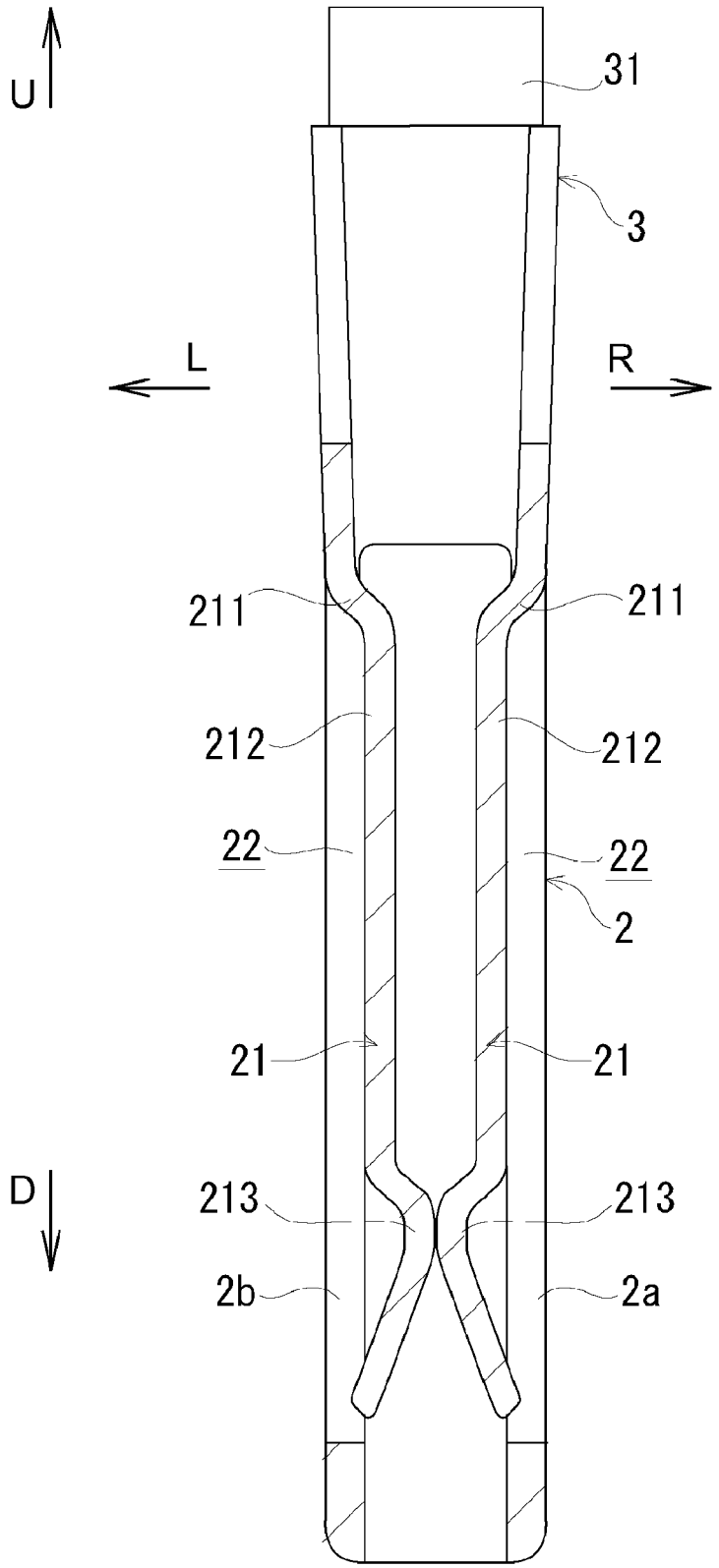
FIG. 2 is an enlarged view illustrating an inside of a frame B in FIG. 1B.

As illustrated in FIGS. 1A to 2, the elastic contact piece 21 has bent portions 211 bent and extending in the terminal container 2 from the left and right lateral plates 2*a* and 2*b*, clamping portions 212 extending from front end portions of the bent portions 211 in the terminal container 2 in a downward direction in the drawing along an extending direction of the left and right lateral plates 2*a* and 2*b*, and contact portions 213 bent and extending from front end portions of the clamping portions 212 in the downward direction in the drawing. The contact portions 213 are bent in an inside of the terminal container 2 from the front end portions of the clamping portions 212 so that the front end portions extend in the left and right outside of the terminal container 2. The contact portion 213 of the elastic contact piece 21 which extends from the right lateral plate 2*a*, and the contact portion 213 of the elastic contact piece 21 which extends from the left lateral plate 2*b* are disposed at opposite positions.

Figure 3:
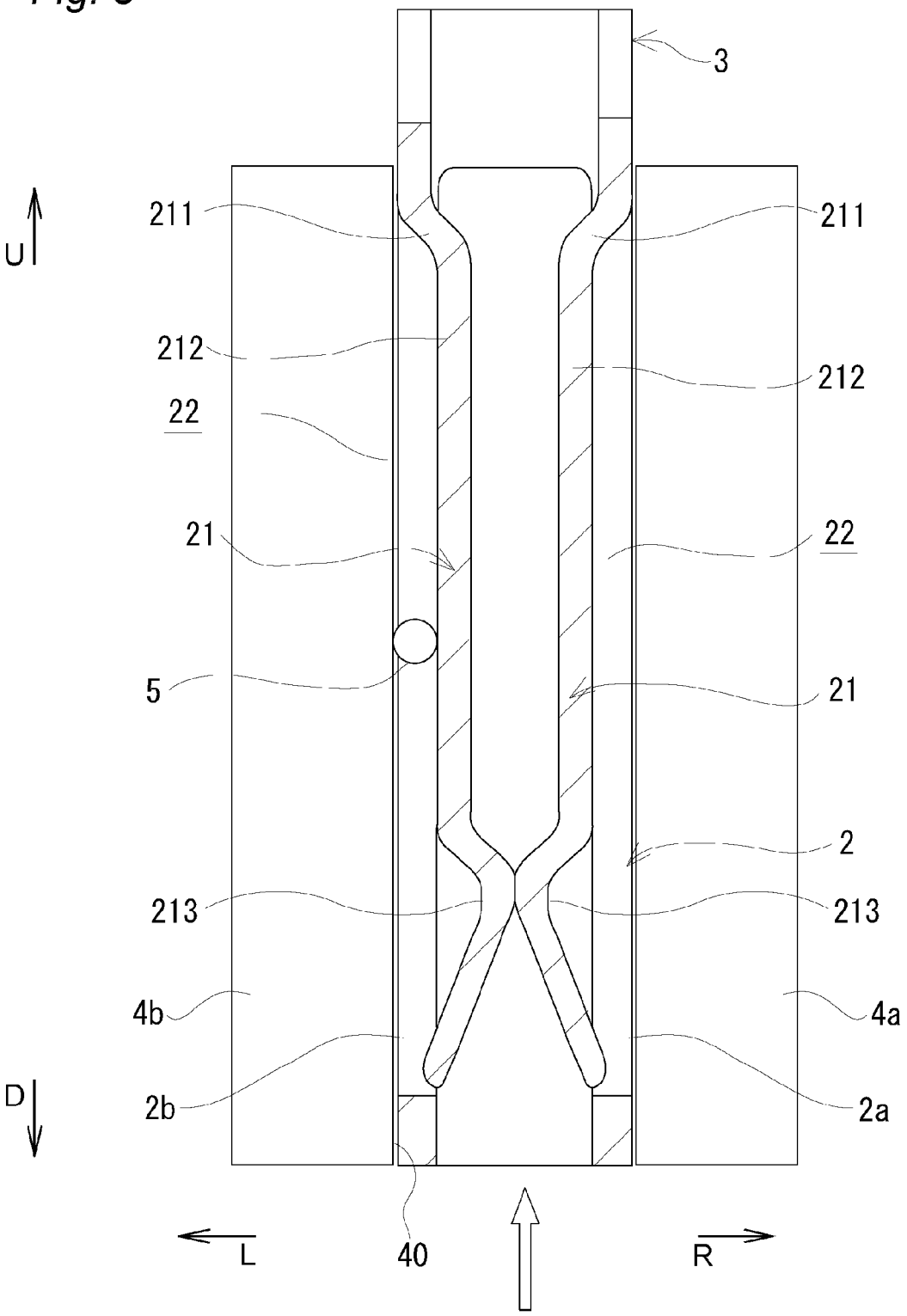
FIG. 3 is a cross-sectional view illustrating a state in which the terminal is accommodated in a terminal cavity.

As enlargedly illustrated in FIG. 3, the terminal 1 is accommodated in a terminal cavity 40 of a connector housing, in which the right lateral plate 2*a* of the terminal container 2 is disposed to be opposite to a right inner wall portion 4*a* of the terminal cavity 40, and the left lateral plate 2*b* is disposed to be opposite to a left inner wall portion 4*b*. Gaps are formed between the elastic contact pieces 21 provided on the left and right lateral plates 2*a* and 2*b* of the terminal container 2, and left and right inner wall portions 4*a* and 4*b* of the terminal cavity 40.

Figure 4:
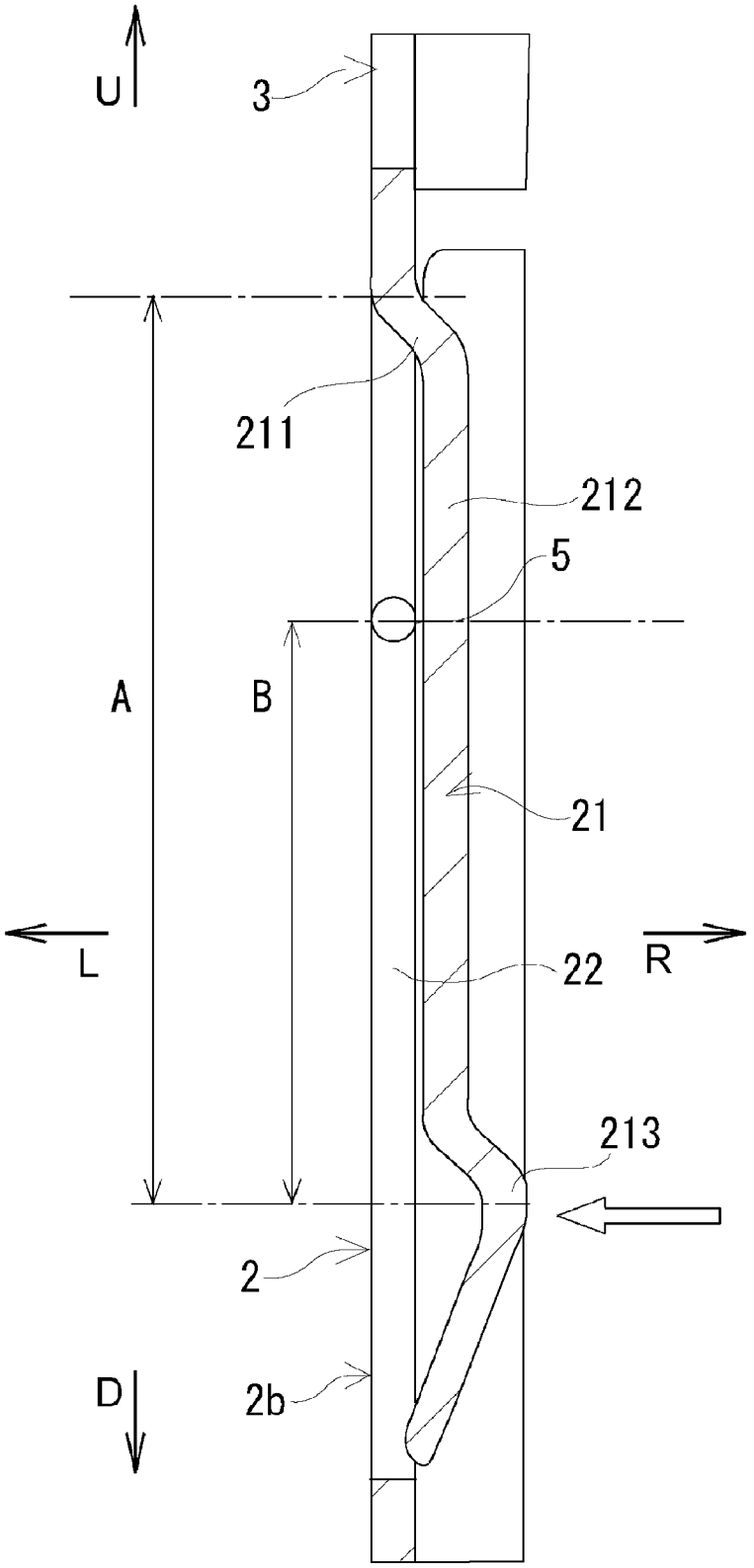
FIG. 4 is a diagram illustrating a state in which an elastic contact piece of the terminal comes into elastic contact with a counterpart terminal and then is bent.

According to the terminal 1, when the counterpart terminal is inserted between the right lateral plate 2*a* and the left lateral plate 2*b* from the lower end side of the terminal container 2 in the drawing, as indicated by a thick arrow in FIG. 3, the contact portions 213 provided on the elastic contact pieces 21 of the left and right lateral plates 2*a* and 2*b* are brought into contact with the counterpart terminal, and then the counterpart terminal is clamped by one pair of elastic contact pieces 21 from both left and right sides thereof. In this instance, as illustrated in FIG. 4, the elastic contact piece 21 is bent in the left and right outward directions of the terminal container 2 within a range of a length A from positions at which the contact portions 213 are formed, with the extending portions of the bent portions 211 from the left and right lateral plates 2*a* and 2*b* serving as a fulcrum. Even though the elastic contact piece 21 is bent outwardly, the gaps formed between the bent portion 211 and the clamping portion 212 and the left and right inner wall portions 4*a* and 4*b* are maintained.

A dimension of the clamping portion 212 is longer than a dimension of the bent portion 211 in the extending direction of the left and right lateral plates 2*a* and 2*b*, so as to prevent foreign substances 5 from entering between left and right inner wall portions 4*a* and 4*b* and the clamping portion 212.

In this embodiment, since the clamping portions 212 of the elastic contact piece 21 extend from the front end portions of the bent portions 211, which are bent in the inside of the terminal container 2 from the left and right lateral plates 2*a* and 2*b*, in the terminal container 2 in a downward direction in the drawing along the extending direction of the left and right lateral plates 2*a* and 2*b*, gaps larger than a bending range of the elastic contact piece 21 clamping the counterpart terminal are formed between the clamping portions 212 and the inner wall portions 4*a* and 4*b*. For this reason, as illustrated in FIGS. 3 and 4, even though the clamping portion 212 is bent in the state in which foreign substances 5 are entered in the gaps formed between the clamping portions 212 and the inner wall portions 4*a* and 4*b*, it is possible to prevent the foreign substances from being sandwiched between the clamping portions 212 of the elastic contact piece 21 and the inner wall portions 4*a* and 4*b* of the terminal cavity 40.

By contrast, in the case where the elastic contact piece 21 does not have the bent portion 211, and the clamping portions 212 are gently inclined from the left and right lateral plates 2*a* and 2*b* and extend downward in the figure, when the counterpart terminal is inserted in the state in which the foreign substances are entered in the gaps formed between the inner wall portions 4*a* and 4*b* of the terminal cavity 40 and the clamping portions 212, the foreign substances are sandwiched between the inner wall portions 4*a* and 4*b* and the clamping portions 212. For this reason, the elastic contact piece 21 is bent within a range of a length B, which is shorter than the length A, from positions at which the contact portions 213 are formed, with the portions, in which the foreign substances are sandwiched, of the clamping portions 212 serving as a fulcrum. As a result, the repulsion force of the elastic contact piece 21 is increased, and thus an insertion/extraction force of the counterpart terminal to the terminal container is also increased.

According to the terminal 1 of this embodiment, after the elastic contact piece 21 is bent in the direction of elastic contact with the counterpart terminal, the elastic contact piece 21 extends along the direction of insertion/extraction of the counterpart terminal to the terminal container 2. Therefore, the gaps, which are larger than the bending range of the elastic contact piece 21, can be formed between the terminal container 2 or the left and right inner wall portions 4*a* and 4*b* of the terminal cavity 40 and the elastic contact pieces 21. For this reason, the elastic contact piece 21 is bent and thus comes into elastic contact with the counterpart terminal, without being affected by the foreign substances 5 entered between the terminal container 2 or the left and right inner wall portions of the terminal cavity 40 and the elastic contact pieces 21.

In the above embodiment, there has been described the case where the elastic contact piece 21 is formed by bending a portion of the right lateral plate 2*a* and the left lateral plate 2*b* of the terminal container 2 within the terminal container 2. However, if the elastic contact piece 21 is bent in the direction of elastic contact with the counterpart terminal and then extends along the direction of insertion/extraction of the counterpart terminal to the terminal container 2, the forming position of the elastic contact piece 21 is optional.

Also, in the above embodiment, there has been described the case where the elastic contact piece 21 is formed by the tongue piece consisting of a portion of the left and right lateral plates 2*a* and 2*b* of the terminal container 2. However, if the elastic contact piece 21 is bent in the direction of elastic contact with the counterpart terminal and then extends along the direction of insertion/extraction of the counterpart terminal to the terminal container 2, the configuration of the elastic contact piece is optional. For example, the elastic contact piece may be formed by a inwardly folded bent piece of the lateral plates 2*a* to 2*c*, or a tongue piece formed by a portion of the bent piece. With the configuration, gaps larger than the bending range of the elastic contact piece 21 are formed between the lateral plates 2*a* to 2*c* or the bent piece and the elastic contact piece 21, so that the elastic contact piece can be bent without being affected by the foreign substances 5 entered between the lateral plates 2*a* to 2*c* or the bent piece and the elastic contact pieces.

In addition, the configuration of the terminal container 2 is optional, and, for example, may be formed in a square box shape having a front plate. Also, the number of the elastic contact pieces 21 provided in the terminal container 2 is optional, and, for example, the elastic contact piece 21 may be provided on any one or all of the right lateral plate 2*a*, the left lateral plate 2*b*, and the rear plate 2*c*. Moreover, the elastic contact piece 21 may extend from the lower end side to the upper end side in the drawing.

Although the present invention is not limited to the above-described embodiment, and can be properly modified or revised. Materials, shapes, dimensions, numerals, forms, numbers, arranged positions or the like of the respective constitutional elements in the above-described embodiment are optional, and are not limited thereto, if they can achieve the present invention.

This application claims priority to Japanese Patent Application No. 2011-023278 filed on Feb. 4, 2011, and the entire disclosure thereof is hereby incorporated herein by way of reference.

INDUSTRIAL APPLICATION

According to the present invention, the gaps larger than the bending range of the elastic contact piece are formed between the inner walls of the terminal cavity or the terminal container lateral and the elastic contact piece, so that the elastic contact piece can be bent without being affected by the foreign substances entered between the gaps.

REFERENCE NUMERALS LIST

1: terminal
2: terminal container
2*a*: right lateral plate (side wall)
2*b*: left lateral plate (side wall)
2*c*: rear plate
21: elastic contact piece
211: bent portion
212: clamping portion
213: contact portion
22: slit
3: electric wire connection
31: metal core crimping portion
32: sheath crimping portion
40: terminal cavity
4*a*: right inner wall portion
4*b*: left inner wall portion
5: foreign substance

The invention claimed is:

1. A terminal comprising:

a pair of elastic contact pieces provided on opposite side walls of a terminal housing and configured to come into elastic contact with a counterpart terminal in the terminal housing, wherein each elastic contact pieces includes a bent portion which is bent inwardly in the terminal housing and extending from a portion of a respective side wall of the terminal housing in the terminal housing, a clamping portion extending from a front end of the bent portion in the terminal housing along an extending direction of the side wall, and a contact portion which is provided at a tip end of the clamping portion and a first portion of the contact portion extending directly from the clamping portion is bent inwardly, and a second portion of the contact portion extending from the first portion is bent outwardly in the terminal housing, wherein an entire length of the clamping portion is longer in the extending direction than an entire length of the bent portion in the extending direction, and wherein a most outwardly disposed part of the contact portion in the lateral direction is disposed at a tip end side of the clamping portion the tip end side of the clamping portion being disposed at a most inner part of the clamping portion in the terminal housing in the extending direction of the side wall, and the most outwardly disposed part of the contact portion is disposed inside respective outer wall surfaces of the side walls and is disposed more outwardly in a lateral direction than the entire length of the clamping portion with respect to the terminal housing.

2. The terminal according to claim 1, wherein a pair of contact portions provided on the elastic contact pieces are brought into contact with the counterpart terminal, so that the counter terminal is clamped by the elastic contact pieces.

3. The terminal according to claim 1, wherein the bent portion and the clamping portion are elastic.

4. The terminal according to claim 1, wherein the bent portion extends from the clamping portion in a direction different than an extending direction of the clamping portion and the extending direction of the side wall.

5. The terminal according to claim 1, wherein each of the elastic contact pieces has a tongue piece formed by providing a U-shaped slit on the side wall.

* * * * *